US009170014B2

(12) United States Patent
Jezsoviczki et al.

(10) Patent No.: US 9,170,014 B2
(45) Date of Patent: Oct. 27, 2015

(54) HEAT SINK FOR LED LUMINAIRE

(71) Applicant: General Electric Company, Schenectady, NY (US)

(72) Inventors: Péter Jezsoviczki, Budapest (HU); Georgina Ambruska, Budapest (HU); János Simonovics, Budapest (HU); Jozsef Samu, Budapest (HU); Thomas Knapp, Cleveland, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 9 days.

(21) Appl. No.: 13/899,718

(22) Filed: May 22, 2013

(65) Prior Publication Data

US 2014/0347868 A1 Nov. 27, 2014

(51) Int. Cl.

| | |
|---|---|
| ***F21V 29/00*** | (2015.01) |
| ***F21V 29/76*** | (2015.01) |
| ***F21S 4/00*** | (2006.01) |
| ***F21V 23/02*** | (2006.01) |
| ***F21V 29/73*** | (2015.01) |
| *F21V 19/02* | (2006.01) |
| *F21Y 103/00* | (2006.01) |

(52) U.S. Cl.

CPC ..... *F21V 29/763* (2015.01); *F21S 4/008* (2013.01); *F21V 23/026* (2013.01); *F21V 29/73* (2015.01); *F21V 19/02* (2013.01); *F21Y 2103/003* (2013.01)

(58) Field of Classification Search

CPC ..... F21S 8/02; F21V 17/00; F21V 29/022; F21V 29/2206; F21V 29/2281; F21V 29/267; F21V 21/04; F21V 21/042; F21V 21/045; F21V 1/06

USPC ..... 362/581, 580, 547, 126, 264, 294, 345, 362/373, 217.01–225; 439/238, 261, 286, 439/312

See application file for complete search history.

(56) References Cited

U.S. PATENT DOCUMENTS

| | | | | |
|---|---|---|---|---|
| 2,721,635 | A * | 10/1955 | Lawson Fullerton | 49/254 |
| 3,375,773 | A * | 4/1968 | Wotowiec et al. | 454/248 |
| 3,473,280 | A * | 10/1969 | Stahlhut | 52/506.07 |
| 3,700,887 | A | 10/1972 | Marx | |
| 4,587,602 | A | 5/1986 | Dean et al. | |
| 4,706,170 | A | 11/1987 | Herst et al. | |
| 5,172,976 | A * | 12/1992 | Bogdanovs | 362/374 |
| 5,851,061 | A | 12/1998 | Hegarty | |
| 5,997,158 | A * | 12/1999 | Fischer et al. | 362/374 |
| 8,066,413 | B2 | 11/2011 | Czech et al. | |
| 8,113,687 | B2 | 2/2012 | Villard et al. | |
| 8,393,765 | B2 * | 3/2013 | Sugishita et al. | 362/375 |
| 2006/0002111 | A1 | 1/2006 | Munson | |
| 2010/0014298 | A1 | 1/2010 | Kim | |
| 2010/0142205 | A1 * | 6/2010 | Bishop | 362/249.02 |
| 2012/0092860 | A1 * | 4/2012 | Blackstone | 362/221 |
| 2012/0162980 | A1 | 6/2012 | Mrakowich | |
| 2013/0223065 | A1 | 8/2013 | Hsieh et al. | |
| 2014/0071699 | A1 * | 3/2014 | Plomteux et al. | 362/373 |

OTHER PUBLICATIONS

A Copy of European Search Report and Opinion issued in connection with corresponding EP Application No. 14170803.2 on Sep. 4, 2014.

* cited by examiner

*Primary Examiner* — Jong-Suk (James) Lee
*Assistant Examiner* — Christopher E Dunay
(74) *Attorney, Agent, or Firm* — GE Global Patent Operation; Peter T. DiMauro

(57) ABSTRACT

An LED luminaire assembly which allows for the easy and safe removal and replacement of the PSU and other internal components wherein the heat sink can be folded or pivoted aside to allow access to and removal of the PSU.

14 Claims, 7 Drawing Sheets

HEAT SINK FOR LED LUMINAIRE

I. FIELD OF THE INVENTION

The present disclosure relates generally to LED luminaires and particularly to recessed or suspended ceiling and wall mounted LED luminaires. More particularly, the present disclosure relates to a system and method for replacing the power supply unit (PSU) and other internal components of a recessed or suspended ceiling or wall mounted LED luminaire.

II. BACKGROUND OF THE INVENTION

LED luminaires that are recessed in a drop ceiling include a housing that can be fitted into common ceiling grid systems. The housing is commonly an extruded aluminum outer shell that is able to lay on the edge of the ceiling grids. The housing encloses the PSU and the LED module, which is generally attached to a heat sink. The housing also encloses any reflectors that are used in the luminaire as well as a diffuser which generally forms the floor of the housing.

FIG. 1 is an example of a prior art luminaire 10 recessed in a ceiling 12. The luminaire includes an elongated housing 14 having a top wall (not shown), two side walls (only one partially shown), and two end walls (one shown). The bottom of the housing is enclosed by a diffuser 16. Diffuser 16 is held in place by retaining lips 17, 18 which run along length "l" of the lower edge of the housing 14.

A prior art LED luminaire 20 is shown in FIG. 2 in cross-section. The luminaire 20 includes a housing having two regions, top region 22 and bottom region 24. Power supply unit 26 is mounted to the inside surface of the top housing region 22. LED module 28 is mounted to the underside of heat sink 30 which in turn is mounted with two rows of screws 32, 34 so that it is between the top housing region 22 and bottom housing region 24. A diffuser 36 sits in the opening of bottom housing region 24 and reflectors 38 fit within bottom housing region 24 between the LED module 28 and the diffuser 36.

In order to access and replace the PSU 26 of the prior art luminaire 20, the diffuser 36, reflectors 38, and heat sink 30 must first be removed. The diffuser 36 and reflectors 38 are lightweight and relatively simple elements to remove. However the heat sink 30 is heavy and it is awkward to unfasten screws 32, 34 and lower the heat sink from the luminaire. Moreover, heat sink 30 has mounted thereto the LED module 28 which is quite fragile and must be carefully handled to avoid damage. Furthermore, any wiring between the LED module 28 and the PSU 26 must be disconnected in order to remove and replace the PSU 26.

In other words, to remove the heat sink 30 from the prior art luminaire 20, the two rows of screws 32, 34 are removed to release the heat sink 30. The heat sink 30, along with any wiring connecting the heat sink 30, LED module 28, and the PSU 26, is then carefully removed. The PSU 26 is then exposed and can be removed and replaced.

Issues with the prior art assembly are evident. The LED module can be damaged during the removal and temporary storage of the heat sink. The heat sink is heavy and awkward and its removal from the housing can be dangerous.

The above-described shortcomings significantly limit the usefulness of field-serviceable LED luminaires (i.e. luminaires having a replaceable PSU). Therefore, there remains a need for an LED luminaire assembly which allows for the easy and safe removal and replacement of the PSU and other internal components.

III. SUMMARY OF THE INVENTION

In at least one aspect, the present disclosure provides a field serviceable solid state lighting device luminaire assembly which allows for the easy and safe removal and replacement of the power supply unit and other internal components.

In at least another aspect, the present disclosure provides a solid state lighting device luminaire assembly wherein the heat sink can be folded aside to allow access to and removal of the PSU.

The present disclosure describes a solid state lighting device luminaire assembly having a housing with a first side wall, a second side wall, a first end wall, and a second end wall and a power supply unit located within the housing. The solid state lighting device module is connected to a heat sink which blocks access to the power supply unit. The heat sink folds or pivots to allow access to the power supply unit.

In one aspect the heat sink extends across the housing and is attached to the first side wall of the housing with a fixed attachment and to the second side wall of the housing with a pivot attachment so that when the fixed attachment is disconnected the heat sink stays attached to the housing at the pivot attachment and pivots towards the second side wall. When the heat sink is pivoted the power supply unit is exposed.

In another aspect, the heat sink extends across the housing and is attached to the first end wall with a fixed attachment and to the second end wall with a removable attachment and the heat sink includes at least two segments connected by a hinged connection. The heat sink can be unattached from the second end wall and folded at the hinged connection to expose the power supply unit.

IV. BRIEF DESCRIPTION OF THE DRAWINGS

Figure 1:
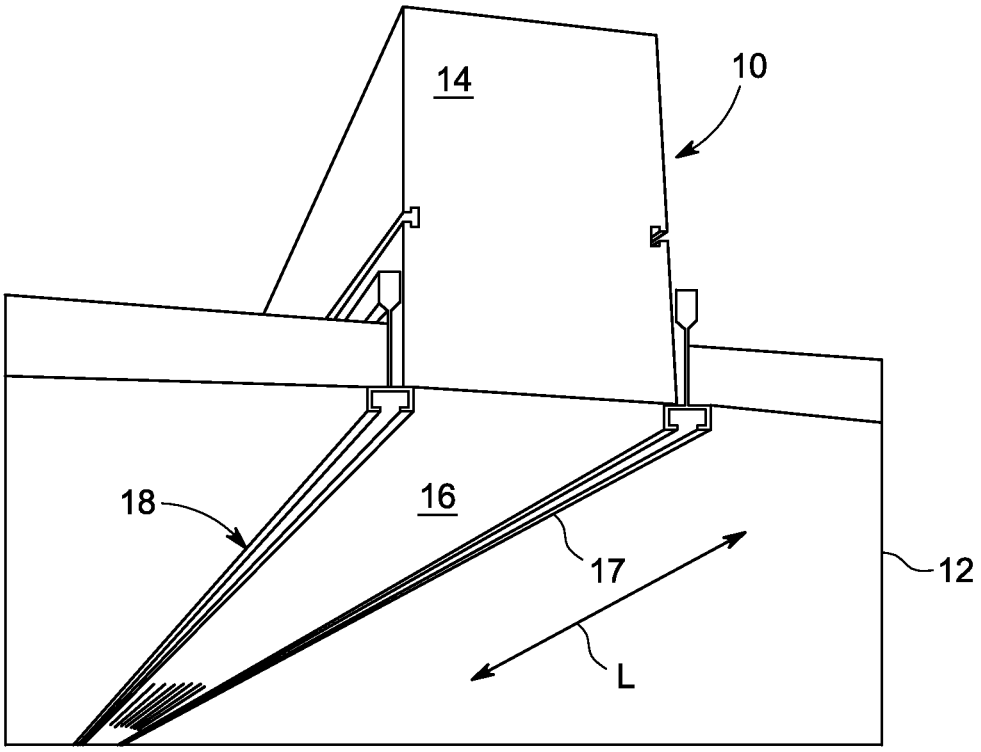
FIG. 1 (PRIOR ART)
FIG. 1 illustrates a prior art ceiling mounted luminaire.
Figure 2:
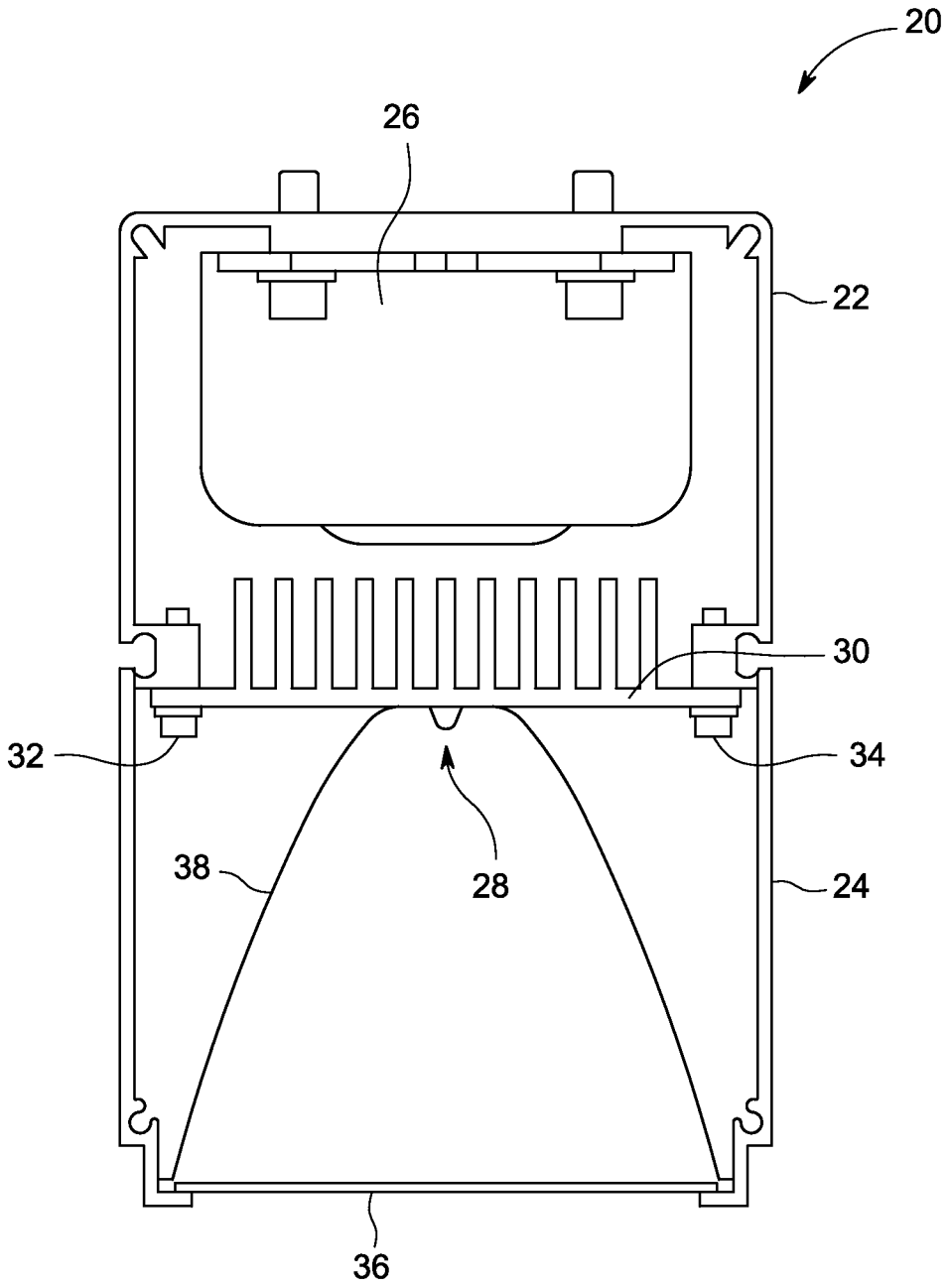
FIG. 2 (PRIOR ART)
FIG. 2 illustrates a schematic view of a prior art LED luminaire.

The present disclosure may take form in various components and arrangements of components, and in various process operations and arrangements of process operations. The present disclosure is illustrated in the accompanying drawings, throughout which like reference numerals may indicate corresponding or similar parts in the various figures. The drawings are only for purposes of illustrating preferred embodiments and are not to be construed as limiting the disclosure. Given the following enabling description of the drawings, the novel aspects of the present disclosure should become evident to a person of ordinary skill in the art.

V. DETAILED DESCRIPTION

The following detailed description is merely exemplary in nature and is not intended to limit the applications and uses disclosed herein. Further, there is no intention to be bound by any theory presented in the preceding background or summary or the following detailed description. While embodiments of the present technology are described herein primarily in connection with LED luminaires for use in recessed drop ceilings, the concepts are also applicable to other types of LED luminaires and luminaires having other light sources. In addition, while the invention is described herein as applicable to LED luminaires it should be understood that it is applicable to other solid-state lighting devices as well. For example light-emitting transistors or organic light-emitting diodes/devices (OLEDs) are applicable alternative SSL devices.

Figure 3:
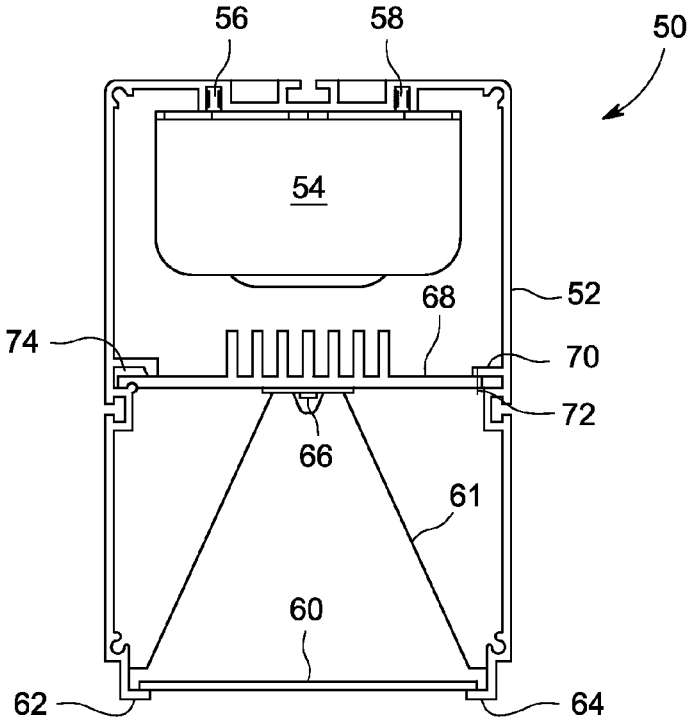
FIG. 3 illustrates a schematic view of an LED luminaire assembly in accordance with at least one embodiment of the present disclosure.

In at least one aspect, the present disclosure provides an LED luminaire assembly. As shown in FIG. 3, the LED luminaire 50 includes a single piece housing 52 which is extruded aluminum, another metal, or plastic. The PSU 54 is mounted to the inside of the housing 52 such as with two rows of bolts 56, 58.

Diffuser 60 is held by inner pointing retaining lips 62, 64 that run the length of the lower edge of the housing 52. Similar retaining lips 17, 18 are shown for the prior art luminaire shown in FIG. 1 running along length "l" of the lower edge of the housing 14.

LED module 66 is mounted on the underside of heat sink 68 by screws, adhesives, or other means (not shown). Heat sink 68 is held in place on one side by fixed attachment to an inwardly directed lip 70 with screws or bolts 72 or temporary or quick release mechanisms such as magnets, tethers, chains, levers, pins, or clevis fasteners. The other edge of heat sink 68 is held in place by a pivoting or hinged attachment 74.

Heat sink 68 is typically aluminum but can be another thermally conductive metal, thermally conductive plastic, or other plastic. Its thickness generally ranges between about 0.5 to 20 mm.

To remove the PSU 54, the diffuser 60 and reflector 61 are removed from the luminaire assembly and placed aside. The screws 72 or other fastening devices are removed, allowing the heat sink 68 to hinge or pivot within the housing 52.

Figure 4:
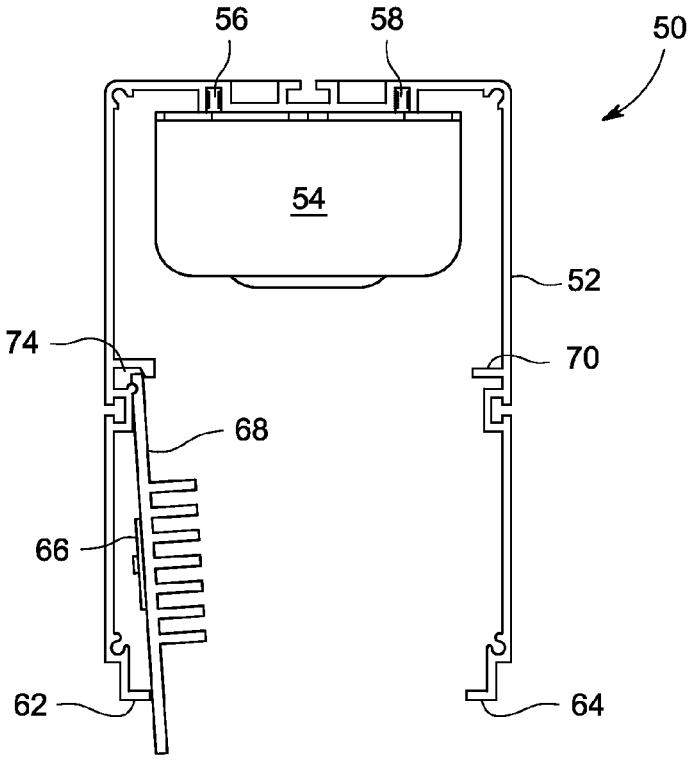
FIG. 4 is another schematic view of the LED luminaire assembly with the heat sink pivoted to allow access to the PSU.

FIG. 4 illustrates the luminaire assembly with the heat sink 68 pivoted to provide access to the PSU 54. Screws 56, 58 can be removed, allowing removal of the PSU 54. The LED module 66 is protected from damage because it is between the heat sink 68 and housing wall 52. Furthermore, heat sink 68 is prevented from pivoting all the way against the housing wall 52 by the lip 62 which also provides protection to the LED module 66.

Figure 5:
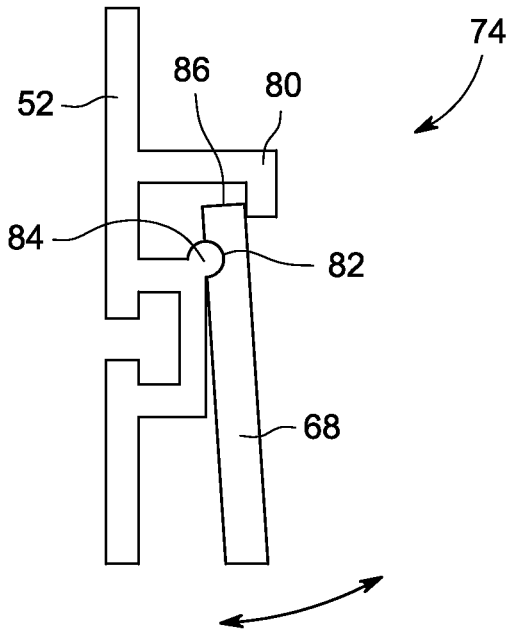
FIG. 5 is an up-close view of the pivot attachment of the heat sink to the housing.

Pivot attachment 74 is shown in more detail in FIG. 5. In this embodiment, the pivot attachment is a longitudinal extruded center of rotation. A retaining finger 80 is extruded as part of housing wall 52. Heat sink 68 includes a divot 82 in the surface thereof which matches with retaining ball 84, also extruded as a segment of housing wall 52. Heat sink 68 rotates around retaining ball 84 on the divot 82 as indicated by the directional arrow and the end 86 of heat sink 68 is retained by retaining finger 80.

Pivot attachment 74 can be segmental along the inside of housing 52 (one or more mechanisms 74) or can be a continuous element.

Pivoting attachments can be used other than the embodiment shown by FIGS. 3-5. For example, other solutions can be a classic door hinge, or a hold open hinge.

Figure 6:
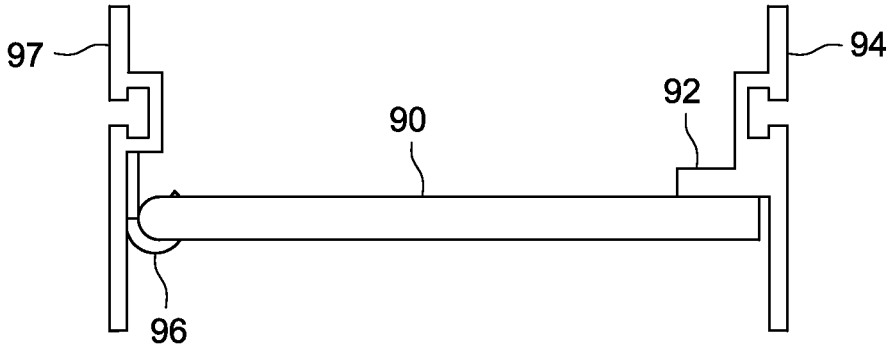
FIG. 6 is a view of another embodiment of a pivot attachment of the heat sink to the housing using a hook mechanism.

FIG. 6 illustrates another embodiment of a pivoting attachment that can be used to provide a pivoting heat sink. The heat sink 90 is fastened on one side to the housing wall inwardly directed lip 92 that is an integral part of the luminaire housing 94. This fixed attachment can be the same as described for the above embodiment. The other side of the heat sink 90 is fastened to the luminaire housing 97 via one or more hooks 96 extending through one or more holes of the heat sink 90. When the heat sink 90 is loosened from the one side it swings or pivots providing access to the PSU.

Figure 7:
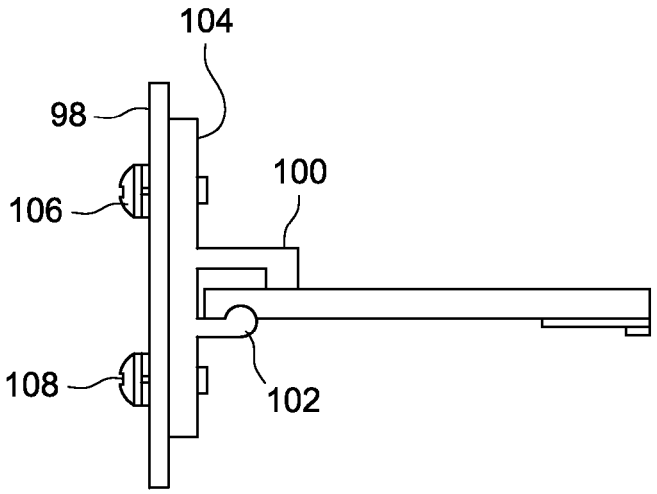
FIG. 7 is a view of another embodiment of a pivot attachment of the heat sink to the housing wherein the pivot mechanism is not an integral part of the housing.

FIG. 7 illustrates a pivot attachment similar to that shown in FIGS. 3-5 except that the mechanism is not an integral part of the housing 98. Instead the retaining finger 100 and retaining ball 102 are a pivot unit 104 attached to the housing 98 with screws or such 106, 108 or welded to the housing 98.

Figure 8:
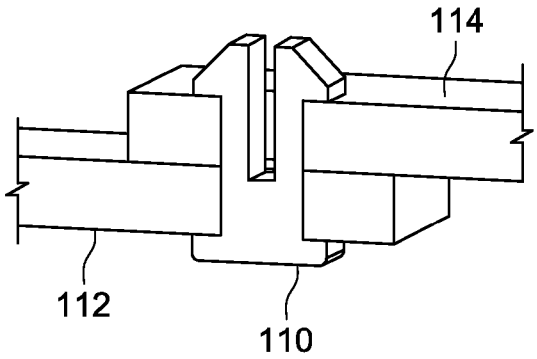
FIG. 8 is a view of another embodiment of the fixed attachment of the heat sink to the housing using a snap-fit fastener.

Heat sink 68 can be attached to housing 52 on its non-pivoting side in a number of ways. One embodiment is shown in FIGS. 3-6. FIG. 8 illustrates another embodiment of a fixed attachment, wherein a snap-fit fastener 110 is used to fasten the heat sink 112 to the housing retaining lip 114.

Figure 9:
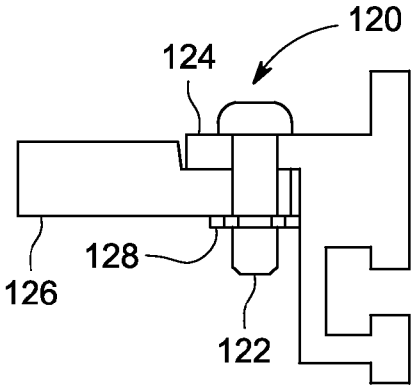
FIG. 9 is a view of another embodiment of the fixed attachment of the heat sink to the housing using a pin and snap ring.

FIG. 9 illustrates yet another embodiment of a fastening means 120 having a pin 122 that extends through the retaining lip 124 and the heat sink 126 and is kept in position by a snap ring 128.

A number of other fastening devices can be used including screws, bolts, slide bolt latches, magnets, rivets, cotter pins, leaf springs, or wedges.

Figure 10:
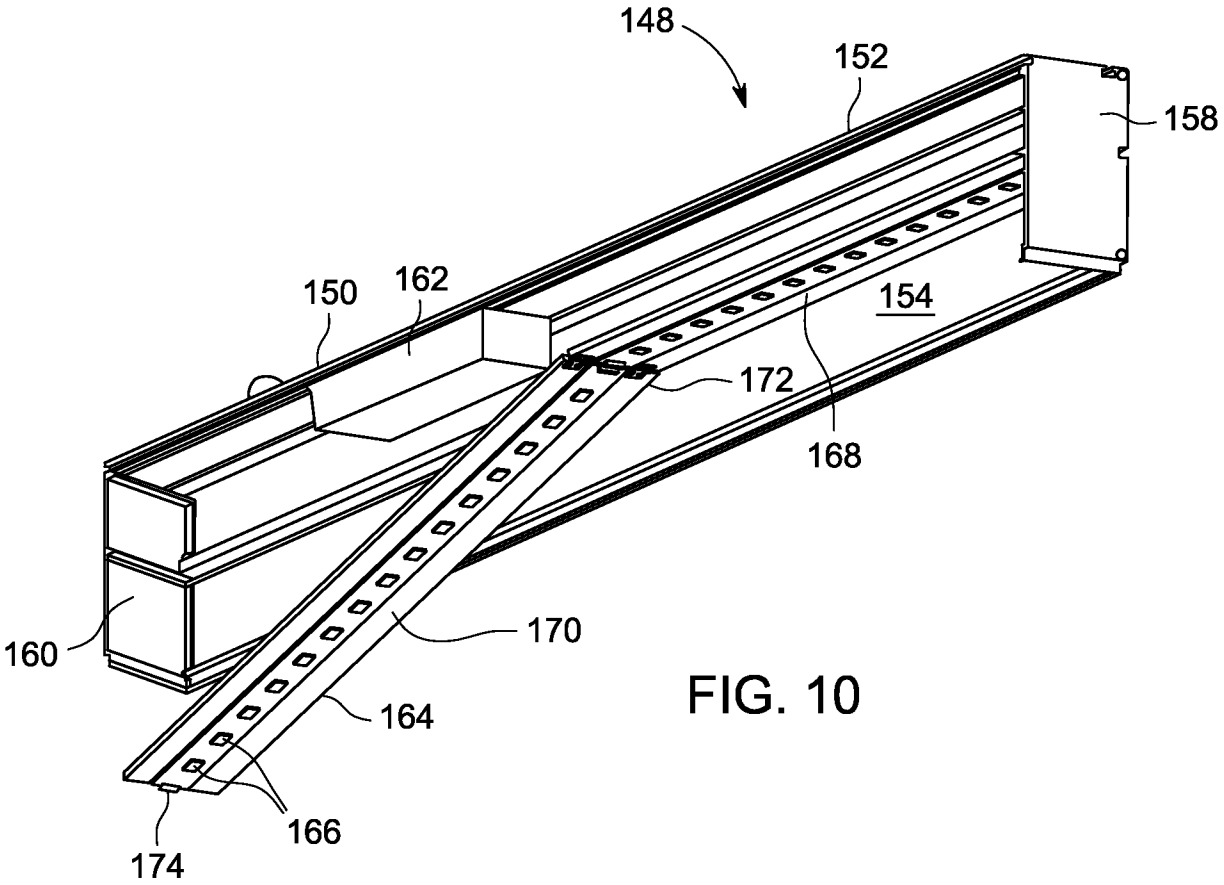
FIG. 10 illustrates an LED luminaire where the LED module is attached to a heat sink which is hinged on an alternative axis.

A second embodiment of a field serviceable luminaire assembly 148 is illustrated in FIG. 10. This embodiment includes a heat sink 164 that folds crosswise to provide access to the power supply unit 162, rather than pivoting lengthwise to provide access as in the previously described embodiment.

As shown in FIG. 10, this embodiment includes a housing 150 with a top panel 152, first side panel 154, second side panel (not shown in this view), and end walls 158, 160. Power supply unit (PSU) 162 is mounted to the top panel 152. Heat sink 164 has a plurality of LED modules 166 mounted thereto. Heat sink 164 has two connected, hinged segments, a permanent segment 168 and a removable segment 170. Segments 168, 170 appear to be shown as being of equal length but they can be of unequal length or the heat sink 164 can be divided into more than two segments. Segment 170 is shown folded in FIG. 10, so that the power supply unit 162 is exposed.

It should also be noted that the luminaire 148 could have multiple power supplies or there may be other components, such as controllers, sensors, terminal blocks, etc. that the service-operator may need to access. Also, the pivoting segment need not be attached at an end of the housing 150. There may be three (or more) segments with the pivoting segment in the middle, for example.

Heat sink 164 is shown with segment 170 folded downwards. In use, heat sink 164 is mounted within housing 150 generally from one end wall 158 to the other end wall 160 and from side wall 154 to the opposite side wall (not shown). The permanent segment is mounted with screws, adhesive, or other attachment means to the housing. The removable segment 170 is attached to the permanent segment 168 with a hinged connection 172 and is attached to the inside of the end wall 160 with a tab 174 which mates in a slot (not shown) on the end wall 160. Other methods of removably attaching the removable segment 170 can be employed.

Figure 11:
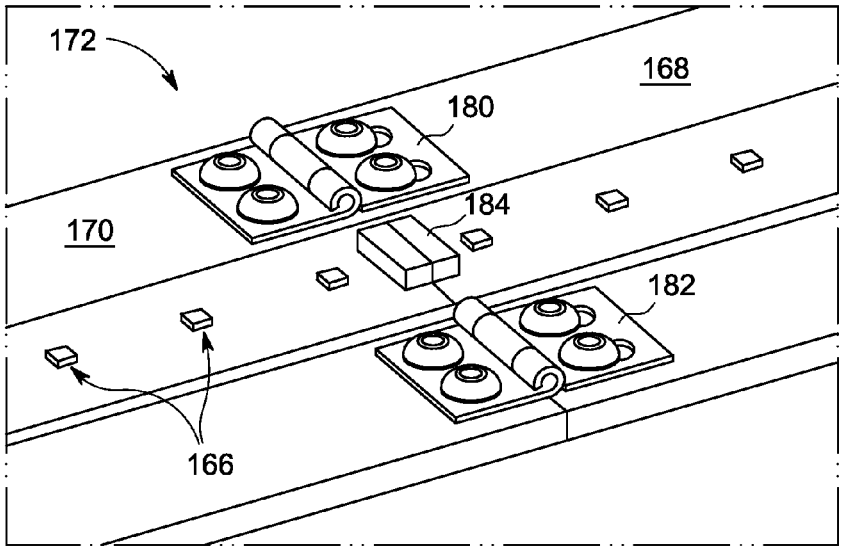
FIG. 11 illustrates one embodiment of a hinged connection between permanent and removable segments of a heat sink.
Figure 12:
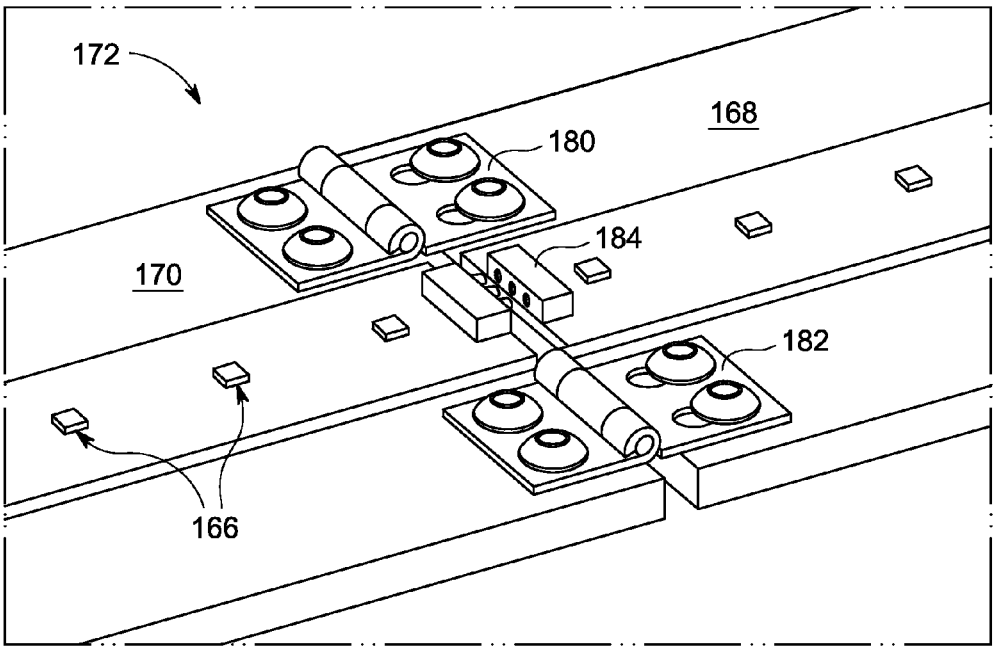
FIG. 12 illustrates the hinged connection of FIG. 11 in disengaged status.

It should be noted that the hinged connection 172 should accommodate any electrical connections between segments 168 and 170. One embodiment of an appropriate hinged connection 172 is shown in FIGS. 11 and 12. As shown in FIG. 11, the permanent segment 168 and removable segment 170 are connected with two slotted hinges 180, 182. Electrical connection between permanent segment 168 and removable segment 170 is made with a connector 184. To disconnect and fold the removable segment 170 it is first pulled to disengage the connector 184 (this step is shown in FIG. 12) and the slotted hinges allow movement of the removable segment 170 away from the permanent segment 168. The removable segment 170 can then be folded as shown in FIG. 10.

The electrical connection between heat sink sections could be a pin connector, ribbon cable, flexible wire, or flexible printed-circuit board. Alternatively, the entire heat sink could be a flexible circuit board that has enough slack at the hinged joint that it can pivot without damaging the board. In that embodiment, a slotted hinge would not be necessary and a standard hinge or other pivoting mechanism would suffice.

This embodiment will desirably include reflectors and these must be removed to access the removable segment 170 of the heat sink 164. The removable segment 170 is then folded down and the power supply unit 162 can be serviced or removed.

Alternative embodiments, examples, and modifications which would still be encompassed by the disclosure may be made by those skilled in the art, particularly in light of the foregoing teachings. Further, it should be understood that the terminology used to describe the disclosure is intended to be in the nature of words of description rather than of limitation.

Those skilled in the art will also appreciate that various adaptations and modifications of the preferred and alternative embodiments described above can be configured without departing from the scope and spirit of the disclosure. Therefore, it is to be understood that, within the scope of the appended claims, the disclosure may be practiced other than as specifically described herein.

We claim:

1. A luminaire assembly comprising:

a housing comprising a first side wall, a second side wall, a first end wall, a second end wall, and an upper wall;

a power supply unit located within the housing;

a heat sink extending across the housing;

a solid state lighting device module connected to the heat sink;

wherein the heat sink is attached to at least the first side wall of the housing;

wherein the heat sink is configured to pivot or fold to allow access to the power supply unit; and wherein the heat sink blocks access to the power supply unit such that the power supply unit is inaccessible when the heat sink is not folded.

2. The luminaire assembly of claim 1, wherein the heat sink is attached to first side wall of the housing with a fixed attachment.

3. The luminaire assembly of claim 2, wherein the power supply unit can be removed from the luminaire when the heat sink is folded.

4. The luminaire assembly of claim 1, wherein the heat sink is configured to fold using at least one pivot attachment.

5. The luminaire assembly of claim 4, wherein the at least one pivot attachment is disposed on the heat sink.

6. The luminaire assembly of claim 4, wherein the heat sink extends across the housing and is attached at the first end wall with a fixed attachment and at the second end wall with a removable attachment.

7. The luminaire assembly of claim 4, wherein the heat sink comprises a first segment affixed to the first end wall and a second segment removably attached to the second end wall.

8. The luminaire assembly of claim 7, wherein the first segment and the second segment are joined with a hinged connector.

9. The luminaire assembly of claim 1, wherein the heat sink comprises a first segment affixed to the first end wall and a second segment removably attached to the second end wall, and a third segment that is connected to at least one of the first segment and the second segment with a hinged connector.

10. A luminaire assembly comprising:

a housing comprising a first side wall, a second side wall, a first end wall, a second end wall, and an upper wall;

a power supply unit located within the housing;

a heat sink extending across the housing and attached to the first side wall and the second side wall; and a lighting module connected to the heat sink;

wherein the heat sink is configured to pivot or fold to allow access to the power supply unit;

wherein the heat sink blocks access to the power supply unit such that the power supply unit is inaccessible when the heat sink is not folded and accessible when folded; and wherein the heat sink comprises a plurality of segments.

11. The luminaire assembly of claim 10, wherein the power supply unit can be removed from the luminaire when the heat sink is folded.

12. The luminaire assembly of claim 1, wherein the heat sink has two connected hinged segments, a permanent segment, and a removable segment.

13. The luminaire assembly of claim 10, wherein at least two segments of the plurality of segments are joined by a connector providing electrical connectivity to the lighting module.

14. The luminaire assembly of claim 13, wherein the heat sink is configured to fold when the connector is mechanically disengaged.

* * * * *